United States Patent [19]

Crockett

[11] 4,227,386

[45] Oct. 14, 1980

[54] LOCK

[76] Inventor: Mattie Crockett, 406 E. Baltimore, Flint, Mich. 48505

[21] Appl. No.: 913,660

[22] Filed: Jun. 8, 1978

[51] Int. Cl.[2] ..... E05B 63/02; E05B 63/12; E05B 63/14; E05C 1/00

[52] U.S. Cl. ..... 70/118; 70/120; 70/131; 70/431; 70/DIG. 43; 292/144; 292/32; 292/157

[58] Field of Search ..... 70/134, 129, 158, 413, 70/DIG. 80, 104, 102, 416, 276, DIG. 43, DIG. 56, DIG. 57, 131, 120, 107, 103, 118, 163, 431, 447, 448, 451; 292/144, 32, 337

[56] References Cited

U.S. PATENT DOCUMENTS

| | | | |
|---|---|---|---|
| 377,983 | 2/1888 | Bohannan | 292/337 |
| 1,107,297 | 8/1914 | Grossmann | 70/107 |
| 1,373,678 | 4/1921 | Siemer | 292/337 X |
| 2,021,803 | 11/1935 | Nichols | 292/337 X |
| 2,103,989 | 12/1937 | Machinist | 70/131 |
| 2,137,002 | 11/1938 | Fehr | 292/337 |
| 2,219,186 | 10/1940 | Hornfeck | 70/276 X |
| 2,461,676 | 2/1949 | Budak | 70/416 |
| 3,768,284 | 10/1973 | Kent et al. | 70/104 |
| 3,785,188 | 1/1974 | Drathschmidt | 70/413 X |
| 3,796,071 | 3/1974 | Crepinsek | 70/131 X |

FOREIGN PATENT DOCUMENTS

| | | | |
|---|---|---|---|
| 10446 | 1/1903 | Austria | 292/144 |
| 917095 | 2/1946 | France | 70/431 |
| 928473 | 6/1947 | France | 70/416 |
| 1312446 | 11/1962 | France | 292/144 |
| 635316 | 4/1950 | United Kingdom | 70/447 |

*Primary Examiner*—Roy D. Frazier
*Assistant Examiner*—Carl F. Pietruszka
*Attorney, Agent, or Firm*—Arnold S. Weintraub

[57] ABSTRACT

A safety or "dead-bolt" lock includes a lockably releasable sliding bolt assembly of a first magnetic polarity. The keeper element, which is adapted to be mounted on to a jamb is of a second or opposite magnetic polarity to magnetically attract the bolt. A key lock assembly is used to release the sliding bar from movement. A cover is slidably movable over the entire lock assembly to prevent unauthorized dislodgement.

6 Claims, 7 Drawing Figures

FIG-1
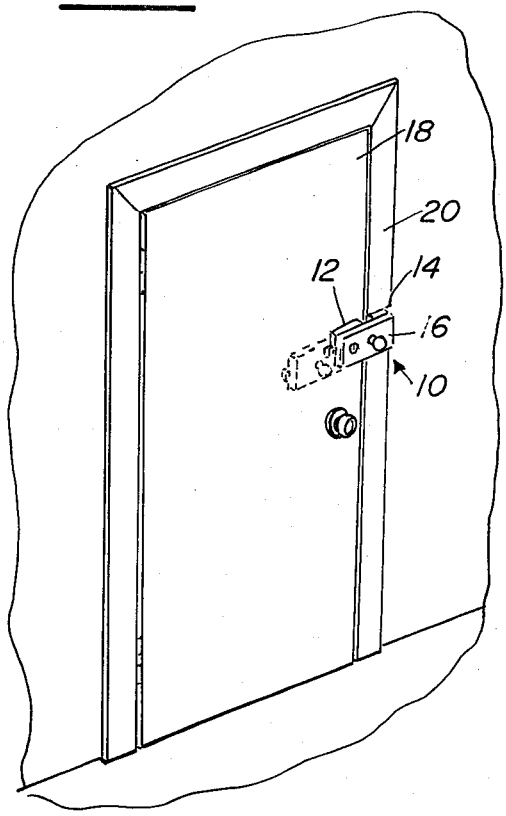
FIG-2
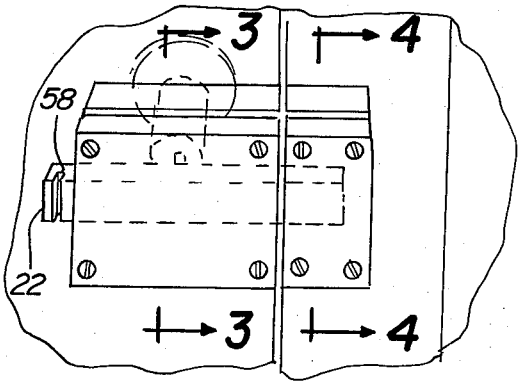
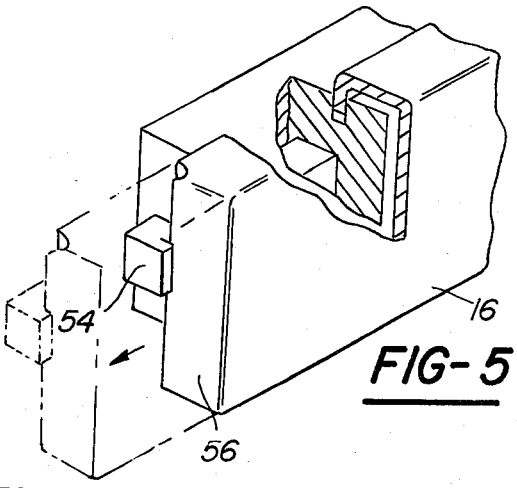
FIG-5
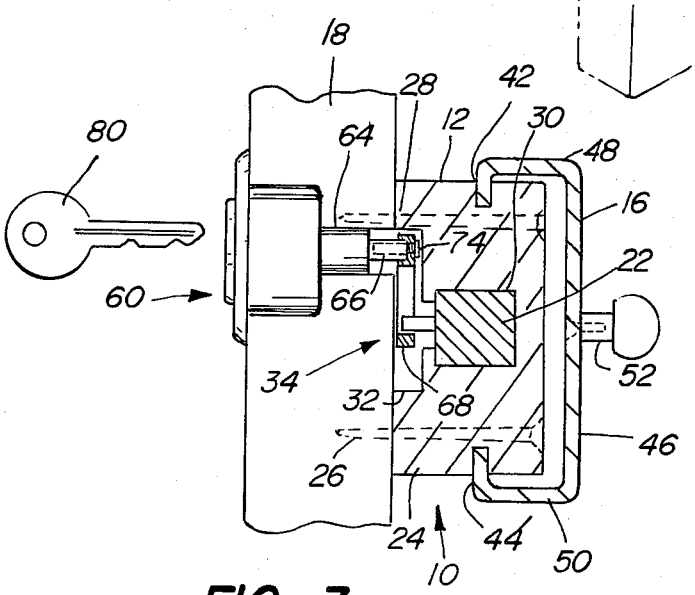
FIG-3
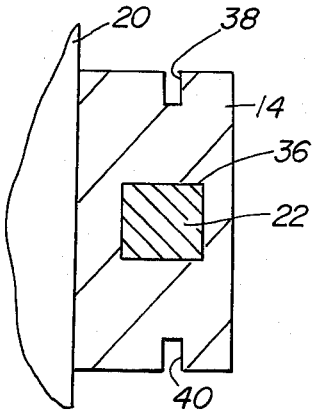
FIG-4

LOCK

BACKGROUND OF THE INVENTION

I. Field of the Invention

The present invention pertains to locks. More particularly, the present invention pertains to sliding bar or dead-bolt locks. Even more particularly, the present invention concerns magnetic dead-bolt locks.

II. Prior Art

The use of locks and the like for security to prevent unauthorized entrances into dwellings and other buildings is, of course, well documented. The prior art is replete with evidence of such security devices. Yet, it can not be controverted, that unauthorized entrances into buildings is a common, every day occurrence. Even more disturbing, however, is the fact that such unauthorized entrances are made directly through the doors or other entrances which have such security devices associated therewith.

Within the broad-spectrum of "security devices" of the type under consideration herein is the sliding bar or "dead-bolt" lock. Conventionally, such devices comprise a door-mounted housing having a sliding bar movably disposed therewithin and a keeper which is mounted onto the door jamb for retention of the bar when in a locked mode. Conventionally, such locks are actuated via a cylinder lock or the like. Usually, and as is known to the skilled artisan, a key is implaced into a cylinder lock or the like where upon it is rotated. Rotation of the cylinder causes axial displacement of the sliding bar into the locking or unlocked mode, depending on the direction of rotation. In a locked mode the sliding bar is retained within the keeper such that the bar traverses the gap between the door and the jamb.

Although such locking devices have met with good success unfortunately such locks can be circumvented. For example, the cylinder lock can be "picked". In other words, a suitable device is used to overcome the springs in the cylinder lock to enable rotation thereof and, thus, the axial displacement of the sliding bolt. Hence, the dead-bolt is overcome.

The present invention, on the other hand, as will subsequently be detailed overcomes many of the deficiencies associated with the dead-bolt type of lock by creating a magnetic force between the keeper and the bolt. Additionally, a cover or the like enshrouds both the housing and the keeper in order to provide a back-up safety feature.

SUMMARY OF THE INVENTION

In accordance with the present invention there is provided a dead-bolt type of lock comprising:

a sliding bar of a first magnetic polarity, a jamb mounted keeper of a second magnetic polarity, means for moving the sliding bar into and out of the keeper, the moving means including a locking means.

Furthermore, in accordance with the present invention the locking means is of a magnetic polarity such that a key or other lock opening device must be of a magnetic polarity to release the lock.

In a preferred embodiment of the present invention a cylinder lock is operatively connected to the sliding bar. The cylinder, per se, need not be of any magnetic polarity. However, if additional safety features are desired, a magnetic polarity must be applied to the cylinder and the key or the like which is used to unlock the cylinder springs must then be of a magnetic polarity opposite to that of the cylinder lest it be repelled by the magnetic flux of the cylinder.

Also, the present invention contemplates a slidable cover which is translatable along a horizontal axis to enshroud the housing as well as the keeper when in an operative mode.

For a more complete understanding of the present invention reference made to the following detailed description and accompanying drawing. In the drawing like reference characters refer to like parts throughout the several views in which:

BRIEF DESCRIPTION OF THE DRAWING

FIG. 1 is a elevational view of a door and jamb having the device of the present invention installed thereon;

FIG. 2 is a front elevational view of the device of the present invention, with the cover removed for purposes of clarity, and as seen from the interior side of a dwelling having the device hereof mounted thereto;

FIG. 3 is a cross-sectional view taken along the line 3—3 of FIG. 2;

FIG. 4 is a cross-sectional view taken along the line 4—4 of FIG. 2;

FIG. 5 is a perspective view, partly in phantom, of the device of the present invention with parts illuminated for purposes of clarity and depicting the use of the sliding cover;

DESCRIPTION OF THE PREFERRED EMBODIMENT

Figure 6:
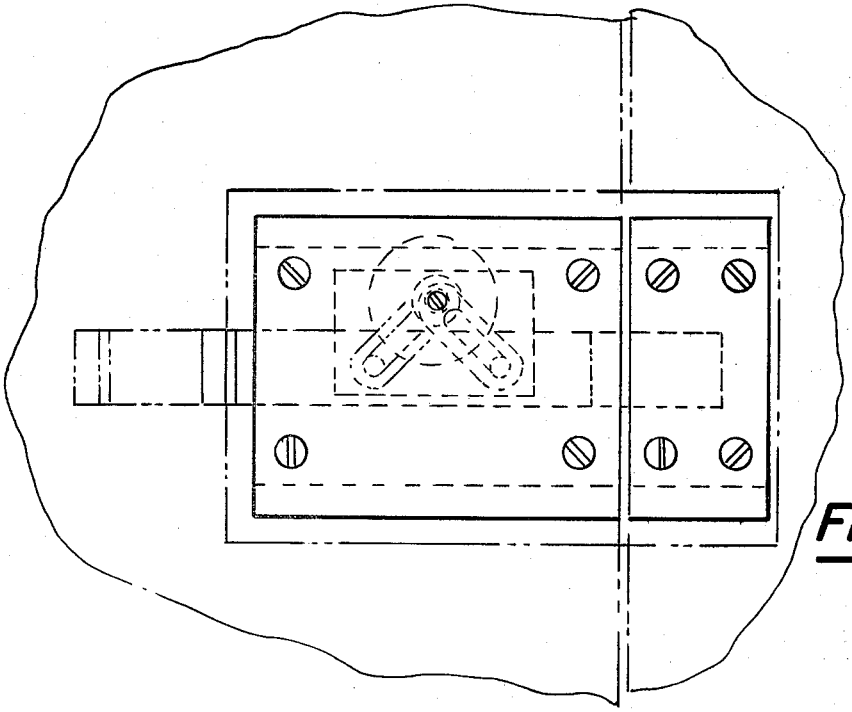
FIG. 6 is a side elevational view of the device of the present invention as seen from the side opposite that of FIG. 2, and partly in phantom.

Now, and with reference to the drawing, there is depicted therein a lock in accordance with the present invention, and, generally, denoted at numeral 10. The lock 10 comprises a sliding bar assembly 12 and a keeper 14 therefor. The lock further comprises a shield or guard 16 which extends or expands between the sliding bolt assembly and the keeper. The keeper assembly 12 is adapted to be mounted to a door 18 with the keeper 14 in axial alignment with the assembly 12 and which is mounted on the door jamb 20. The assembly 12, also, comprises a sliding bolt 22 which is engagable with the guard 16 and which is axially translatable into and out of the keeper 14, in a manner to be described subsequently.

In accordance with the present invention the sliding bolt 22 is formed of a material having a first magnetic polarity with the keeper 14 having a second or opposite magnetic polarity. Thus, in addition to the normal mechanical relationship existing between the components hereof there is also a magnetic attraction.

With more particularity, the keeper assembly 12 comprises a housing 24 which is adapted to be mounted to the interior side of the door 18 via any suitable mode such as fastening means 26 or the like. Conventionally, the fastening means comprise screws which project through suitable bores 28 formed in the housing 24 and into threaded mounting to the door 18. Such mounting, per se, is well known.

A central bore 30 is formed in the housing 24 centrally thereof and extends therethrough. The sliding bolt 22 is disposed within the bore 30 and is mounted for sliding movement therewithin. The central bore 30 is in communication with a recess 32 in which is mounted and disposed the sliding bolt actuating mechanism generally denoted at 34 and which is described in detail subsequently.

The keeper 14, as noted, is mounted to the jamb and is in axial allignment with the sliding bolt assembly. The keeper comprises a solid member 14 having a central bore 36 which is adapted to slidingly receive therewithin the sliding bolt 22. As herein above noted the keeper 14 has a second or opposite magnetic polarity to that of the sliding bolt 22.

The upper and lower wall of the keeper is provided with a groove 38, 40, respectively. The grooves 38 and 40 are in registry with upper and lower grooves 42, 44, respectively formed in the sliding bolt assembly housing 24. The shield or guard 16 is mounted for sliding movement within the grooves. More particularly, and as shown in the drawing, the shield 16 comprises a plate 46 which enshrouds or covers the assembly 12 and the keeper 14 when in actuated position. The plate has a height substantially equal to the height of the assembly 12 and keeper 14, as shown. Inwardly directed J-flanges 48, 50 are integrally formed with the plate 46 at the upper and lower ends thereof, as shown. The terminal or hook portions of the flanges are disposed within the grooves. Thus, as an axial translation is imparted to the shield it slides in an axial direction with the terminal ends of the flanges sliding in the grooves. Since the grooves are in registry between the assembly 12 and keeper 14, the shield slides therebetween. A handle or grasping means 52 is mounted onto the plate 46 and projects outwardly therefrom. Thus, the shield is easily translated between the positions shown in phantom and in solid line in FIG. 1. In the phantom position shown in FIG. 1 unlocking of the assembly is easily afforded. In the positions shown in solid line in the drawing access past the lock assembly hereof is virtually impossible. Assuming that the magnetic forces could be overcome it would still be incumbent to effectuate a sliding movement of the guard in order to get past the door. In accordance with the present invention and in one embodiment thereof, and as will subsequently be detailed the sliding bolt can be slid to a retracted or unlocked position without disturbing the guard thereby further enhancing the safety value hereof.

As shown in the drawing the free end of the sliding bolt has a flange or shoulder 54 which is engagable with the side wall 56 of the shield. Thus, as the shield is translated to the open position it engages the sliding bolt flange to thereby retract same from the keeper 14. Alternatively, and as shown in FIG. 2, it is possible to form a vertical groove or slot 58 in the sliding bolt with the side wall 56 of the shield being implaced therewithin. In this manner the shield and the sliding bolt are co-acting, if desired.

In any event, the actuation of the sliding bolt is achieved through the means 34.

Figure 7:
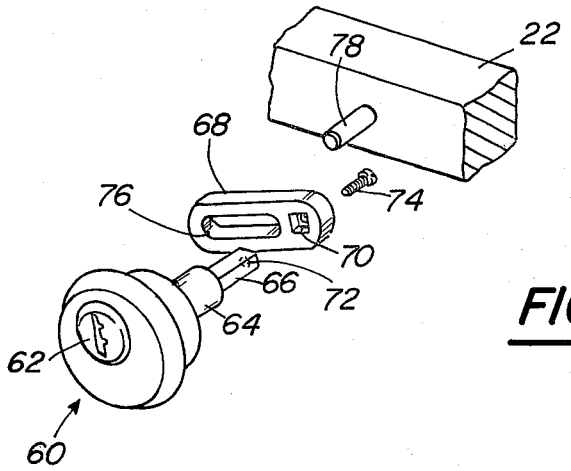
FIG. 7 is an exploded, perspective view of a lock mechanism for utilization with the device of the present invention.

Referring now to FIGS. 3 and 7 there is illustrated therewithin the actuation means 34 utilized in the practice of the present invention.

The sliding bolt 22 is actuated via a lock or locking means, generally, denoted at 60 and which is interconnected to the actuation means 34.

The locking means 60 comprises a conventional cylinder lock 62 which is mounted to the door 18 from the exterior side thereof. The lock, as contemplated herein, comprises a cylinder lock 64 of well known construction. As is known to those skilled in the art to which the invention pertains such cylinder locks are key-operated mechanisms wherein insertion of the key into the cylinder causes retraction of springs or the like to enable rotation of the cylinder. Such structure, per se, is known to the skilled artisan. Associated with the cylinder 64 is a crank or projecting pin 66. The pin 66 rotates in response to rotation of the cylinder 64. The free end of the pin 66 is fixedly mounted to a toggle 68. The toggle 68 is disposed within the cavity or recess 32. The toggle 68 has an aperture or opening 70 formed therewithin into which projects the pin 66. The free end of the pin 66 has a threaded opening 72 which receives a threaded fastener 74 which is inserted through the opening 70 to fixedly mount the pin 66 to the toggle 68.

The toggle has a central key-way or slot 76 formed there within. The slot 76 engages a shank or pin 78 which projects from the sliding bolt 22 and is integrally formed therewith.

As clearly shown in FIGS. 3, 6 and 7 the lock or locking means 60 is mounted from the exterior of the door and projects inwardly therethrough via suitable openings or bores drilled or otherwise formed within the door. The pin 66 projects into the recess or cavity 32 in which is disposed the toggle 68. The slot 76 engages the pin 78 to thereby interconnect the sliding bolt to the cylinder lock 64.

In practicing the present invention it is contemplated that the cylinder have a first magnetic polarity. Hence, in order to be able to insert a key or other release mechanism for rotation of the cylinder it would be incumbent that such actuating member be formed of a second or opposite magnetic polarity. This further insures the safety factors of the present invention.

Assuming that a key 80 or simular member be employed herein the key is inserted into the cylinder 64. Rotation of the key in a first direction causes the sliding bolt to be thrust into the keeper 14. Rotation of the key in a second or opposite direction causes retraction of the sliding bolt from the keeper and the contemporaneous opening of the door. Depending upon the interengagement between the shield 16 and the sliding bolt it is possible that the shield be retracted along with the retraction of the sliding bolt. It is preferred, however, that the shield be operated independently of the sliding bolt. Thus, unauthorized entrances which overcome the sliding bolt and cause the retraction thereof would still not enable entrance into the dwelling or similar structures since the shield would still be positioned.

Furthermore, by having the shield operate independently it is possible that the sliding bolt could not be in the locked position, the safety features still provided by the spanning of the shield between the assembly 12 and the keeper 14.

It is apparent that from what has been described herein there is provided a magnetic lock system having independent means associated therewith which overcomes the problems herein above enumerated.

Having, thus, described the invention what is claimed is:

1. A dead-bolt lock, comprising:

(a) a sliding bar of a first magnetic polarity, (b) a jamb mounted keeper of a second magnetic polarity, (c) means for moving the sliding bar into and out of the keeper, (d) locking means for locking the moving means, and (e) a cover translatable to enshroud the sliding bar and the keeper.

2. The lock of claim 1 which further comprises:

a housing, the sliding bar being slidably mounted in the housing.

3. The lock of claim 2 wherein:

the housing has a track formed therein, the keeper has a track formed therein, the housing track and keeper track being in registry and the cover being slidable in the tracks.

4. The lock of claim 1 which further comprises:

means interconnecting the sliding bar to the cover such that the movement of the cover causes contemporaneous movement of the sliding bar.

5. The lock of claim 1 which further comprises:

a handle for grasping the cover.

6. The lock of claim 1 wherein:

(a) the sliding bar has a notch formed therein, (b) the cover has a first wall fitted into the notch, the notch and cover wall cooperating to define means for interconnecting the sliding bar to the cover.

* * * * *